US005994977A

United States Patent [19]

Taya

[11] Patent Number: 5,994,977

[45] Date of Patent: Nov. 30, 1999

[54] HIGH FREQUENCY SIGNAL DIRECTIONAL COUPLING LINE

[75] Inventor: Keiichiro Taya, 2-2-1 Takiyama, Higashikurume-shi, Tokyo-to, Japan

[73] Assignees: Yashima Denken Kabushiki Kaisya; Keiichiro Taya, both of Tokyo-to, Japan

[21] Appl. No.: 09/090,547

[22] Filed: Jun. 4, 1998

[51] Int. Cl.[6] ..... H01P 5/18

[52] U.S. Cl. ..... 333/111; 333/115

[58] Field of Search ..... 333/111, 115, 333/237; 343/768, 770, 895

[56] References Cited

U.S. PATENT DOCUMENTS

| | | | |
|---|---|---|---|
| 2,531,777 | 11/1950 | Marshall | 333/111 |
| 2,601,610 | 6/1952 | Hatch et al. | 343/768 |
| 2,602,893 | 7/1952 | Ratliff, Jr. | 343/768 |
| 3,593,143 | 7/1971 | Nakahara et al. | 343/768 X |
| 3,810,186 | 5/1974 | Nakahara et al. | 333/237 X |
| 4,675,622 | 6/1987 | Taya | 333/115 X |

FOREIGN PATENT DOCUMENTS 2579583 9/1997 Japan .

*Primary Examiner*—Paul Gensler
*Attorney, Agent, or Firm*—Price, Heneveld, Cooper, DeWitt & Litton

[57] ABSTRACT

A high frequency signal line facilitates the adjustment of the strength of branched output or inductively coupled leakage field depending on the particular requirement of operation. In the preferred embodiment, a transmission line consists of a central conductor and a cylindrical outer conductor formed with a longitudinally extending opening, the transmission line being covered with a cylindrical shielding shutter formed with a longitudinally extending opening. The high frequency signal line also includes an induction line including a trough-shaped shielding cover formed with a longitudinally extending opening and which is adapted to be detachably attached to the shielding shutter. The induction line also includes a directional coupling conductor for high frequency coupling which extends within the shielding cover generally parallel to the central conductor.

19 Claims, 5 Drawing Sheets

HIGH FREQUENCY SIGNAL DIRECTIONAL COUPLING LINE

BACKGROUND OF THE INVENTION

Field of the Invention

This invention relates to a high frequency signal line adapted to be selectively used as an open-type (leakage) or as a closed-type (transmission) signal line.

Known high frequency signal lines, such as that described in Japanese Patent No. 2579583, typically include a coaxial cable having a central conductor and a cylindrical outer conductor. The outer conductor includes a longitudinal opening, and contains the central conductor therein. In addition, known signal lines of this type include a series of shielding covers arranged along the longitudinal opening of the outer conductor and adapted to be detachably attached to the opening.

The signal line also includes a directional coupling conductor for high frequency coupling. The directional coupling conductor is disposed within at least one of the shielding covers and is positioned to extend parallel to the central conductor. A matching resistor is connected to one end of the directional coupling conductor, and a branch line is connected to the other end of the directional coupling conductor. The space defined between the central conductor and the outer conductor is typically filled with an insulator.

As will be apparent from the foregoing description, known high frequency signal lines are constructed in a relatively simple manner in which the shielding cover is mounted outside of the opening of the outer conductor. However, such construction often makes it difficult to secure the shielding cover to the opening and inevitably is accompanied by a significant risk that the outer conductor might come in contact with the directional coupling conductor. In addition, with respect to high frequency signal lines, the strength of the branched output signal necessarily depends on the length of the induction line and, therefore, to adjust a strength of the output, known high frequency signal lines require induction lines of different lengths. Consequently, shielding covers of different lengths are also required.

SUMMARY OF THE INVENTION

In order to solve the problems described above, it is a principal object of the invention to provide a high frequency signal line adapted to minimize the chance that the outer conductor and the directional coupling conductor come in contact with each other. A further object is to provide a signal line that is adapted to adjust the signal strength of the branched output or leakage field according to the particular requirement of operation.

The objects of the invention set forth above are achieved, according to one aspect of the invention, by a high frequency signal line having a transmission line including a central conductor and a cylindrical outer conductor formed with a longitudinal opening. The transmission line is covered with a cylindrical shielding shutter formed with a longitudinal opening. The signal line also includes an induction line having a trough-shaped shielding cover formed with a longitudinal opening, the induction line being adapted to be detachably attached to the shielding shutter. Further, the induction line includes a directional coupling conductor that extends within the shielding cover, parallel to the central conductor, for high frequency coupling.

According to another aspect of the invention, a high frequency signal line has a transmission line including a central conductor and a cylindrical outer conductor formed with a longitudinal opening. The transmission line is covered with a cylindrical shielding shutter formed with a longitudinal opening. The signal line additionally includes an induction line having a shielding cover. According to this aspect of the invention, the shielding cover is adapted to be detachably fastened, under an interlocking effect, to the outer conductor. Further, for high frequency coupling, the induction line includes a directional coupling conductor that extends within the shielding cover, parallel to the central conductor.

According to still another aspect of the invention, a high frequency signal line has a transmission line including a central conductor and a cylindrical outer conductor formed with a longitudinal opening. The transmission line is covered with a cylindrical shielding shutter formed with a longitudinal opening such that the opening of the transmission line can be adjustably widened or restricted.

According to a further embodiment of the invention, a high frequency signal line has a transmission line including a central conductor and a cylindrical outer conductor formed with a longitudinal opening. The transmission line is covered with a cylindrical shielding shutter partially formed with a spiral opening.

The objects of the invention set forth above are achieved, according to an additional embodiment of the invention, by a high frequency signal line having a transmission line including a central conductor and a cylindrical outer conductor formed with a spiral opening. The transmission line is covered with a shielding shutter partially formed with a longitudinal opening.

According to still another embodiment of the invention, a high frequency signal line has a transmission line including a central conductor and a cylindrical outer conductor formed with a longitudinal opening. The outer conductor has a pair of rail supporting wings on opposite sides of the longitudinal opening, on which rails are laid in parallel to the outer conductor. The signal line further includes an induction line including a shielding cover provided with wheels by which the shielding cover can move along the rails. Also, the induction line includes a directional coupling conductor that extends within the shielding cover, parallel to the central conductor, for high frequency coupling.

It is also possible to cover the transmission line with the cylindrical shielding shutter formed with a longitudinal opening. Further, the rail supporting wings may be formed integrally with the outer conductor or the shielding shutter.

These and other features, advantages and objects of the present invention will be further understood and appreciated by those skilled in the art by reference to the following specification, claims and appended drawings.

DETAILED DESCRIPTION OF THE EMBODIMENTS

Figure 1:
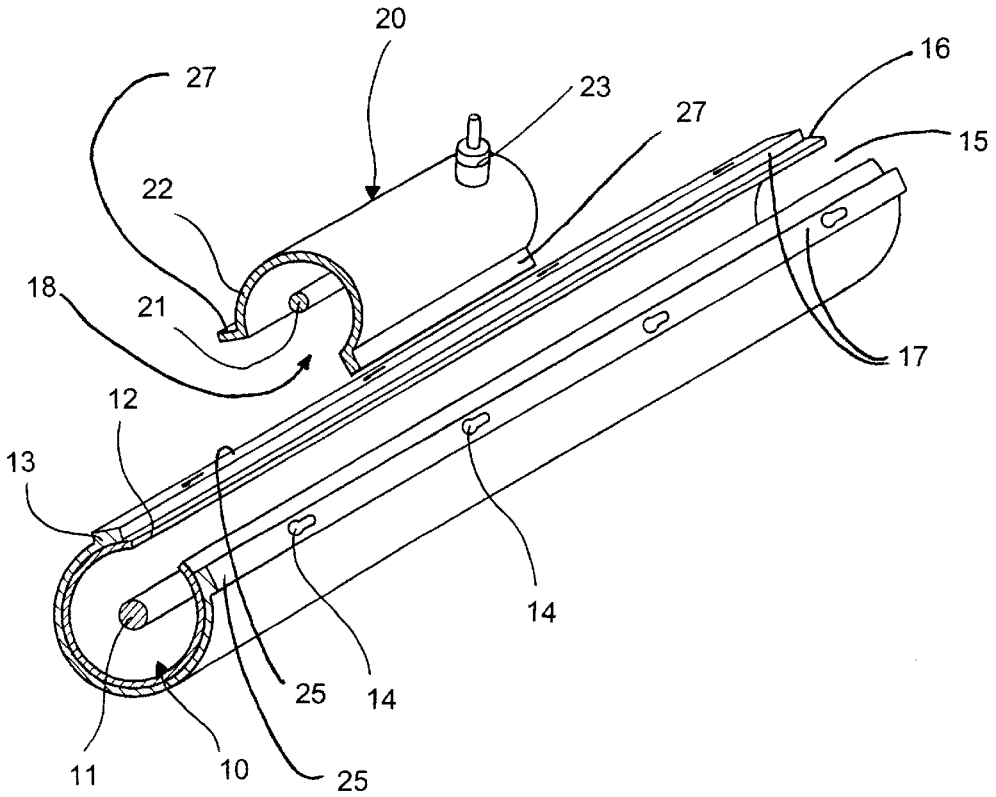
FIG. 1 is a fragmentary perspective view showing a first embodiment of the high frequency signal line according to the invention.
Figure 2:
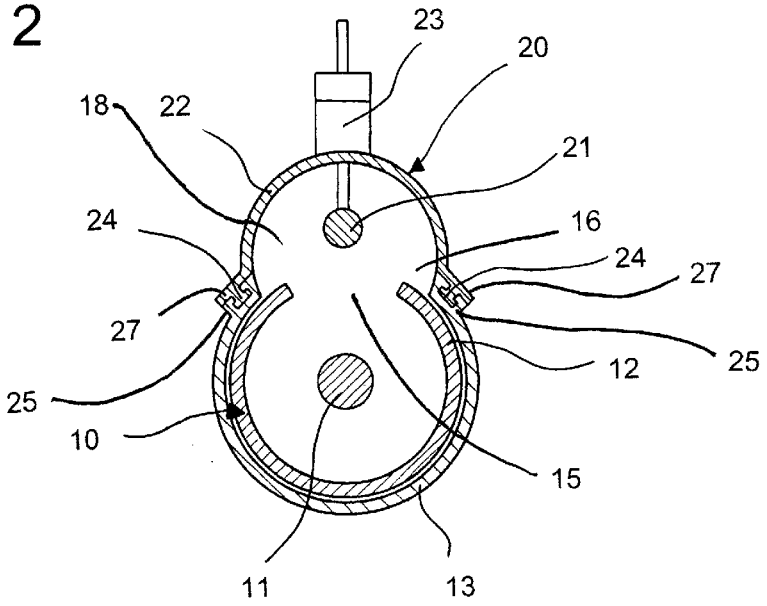
FIG. 2 is a sectional end view showing the first embodiment in a first position of operation.
Figure 3:
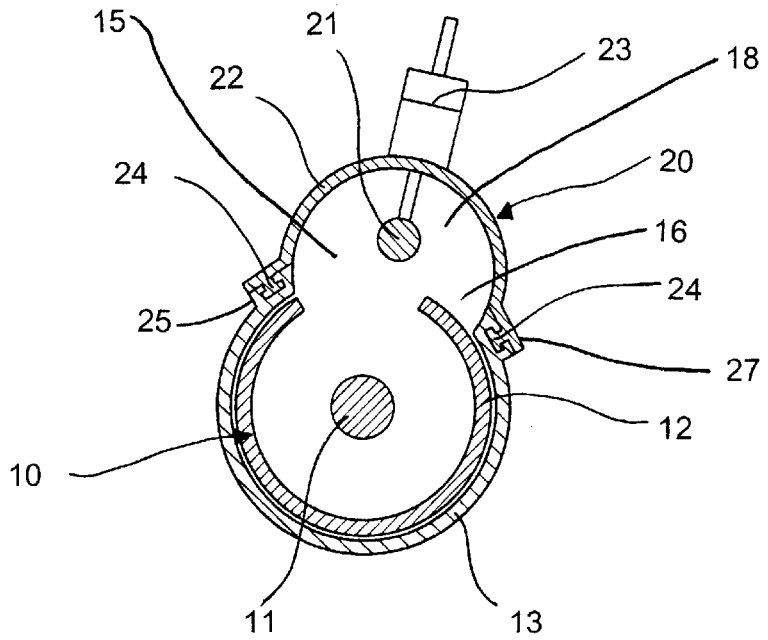
FIG. 3 is a view similar to FIG. 2 showing the first embodiment in a second position of operation.
Figure 4:
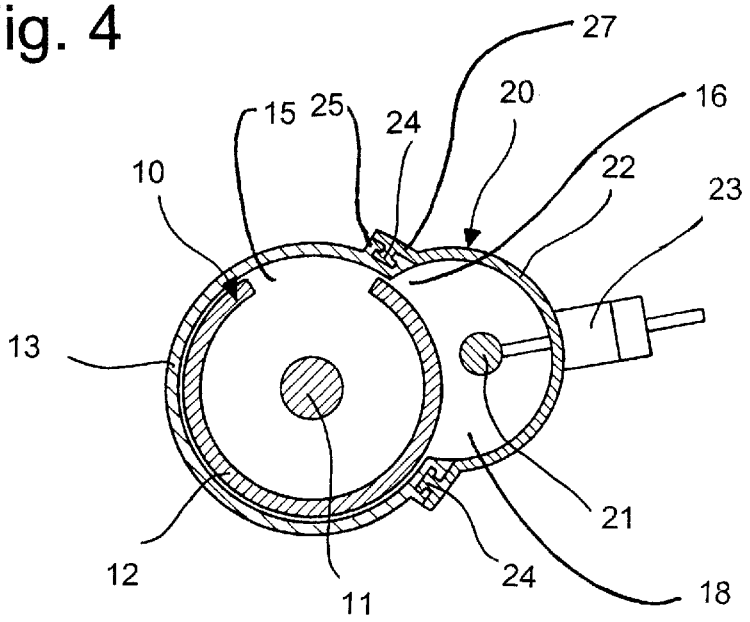
FIG. 4 is a view similar to FIG. 2 shown in the first embodiment in a third position of operation.

FIG. 1 is a perspective view showing a first embodiment and FIGS. 2–4 are sectional end views illustrating the manner in which the first embodiment operates. According to the first embodiment, a high frequency signal line consists of a transmission line 10 and an induction line 20. The transmission line 10 has a central conductor 11 and a cylindrical outer conductor 12 having its peripheral wall interrupted along a longitudinally extending opening 15 such that the outer conductor 12 has a C-shaped cross section. The outer conductor 12 is covered by a shielding shutter 13 that is positioned in close contact with the outer conductor 12 and, like the outer conductor 12, has a longitudinally extending opening 16 through its peripheral wall. The shielding shutter 13 is adapted to be rotated closely around the outer conductor 12 to various positions including those shown in FIGS. 2–4. The opening 15 of the outer conductor 12 is dimensioned to be slightly narrower than the opening 16 of the shielding shutter 13 so that the opening 15 of the outer conductor 12 is fully exposed when aligned with the opening 16 of the shielding shutter 13 (FIG. 2). Along each of opposite side edges defining therebetween the opening 16 of the shielding shutter 13, there is provided a raised portion 25 containing a series of keyhole-shaped holes 14 at regular intervals for receiving corresponding pins 24 formed on a shielding cover 22, as described below, to fasten the shielding cover 22 to the shielding shutter 13.

The induction line 20 includes the shielding cover 22 which is shaped like a trough having an opening extending longitudinally of the line 20 and a directional coupling conductor 21 extending within the shielding cover 22 parallel to central conductor 11 for high frequency coupling. The shielding cover 22 has an opening 18 and is adapted to be detachably attached to the shielding shutter 13. As shown in FIG. 1, the opening 18 of the shielding cover 22 is aligned with the opening 16 of the shielding shutter 13. Induction line 20 is adapted to be connected by a connector 23 provided on an end of the directional coupling conductor 21 to a branch circuit (not shown). Conductor 21 is mounted to cover 22 in insulative relationship in a known manner. Along each of outwardly-projecting opposite edges 27 defining the opening 18 of the shielding cover 22, there are provided a series of pins 24 that are adapted to be inserted into the corresponding holes 14 formed in opposed raised edges 25 of the shielding shutter 13 to fasten the shielding cover 22 to the shielding shutter 13.

From the position shown in FIG. 1, the shielding shutter 13 can be rotated together with the induction line 20, as seen in FIGS. 2–4. FIG. 2 is a sectional view illustrating a normal state in which the high frequency signal line can operate. The pins 24 of the shielding cover 22 are fitted into the corresponding holes 14 of the shielding shutter 13. Thereupon, the longitudinal opening 15 of the outer conductor 12 is positioned at its fully opened position relative to the opening 16 of the shielding shutter 13 such that a signal coupling can be achieved at the maximum signal input/output. As will be apparent from FIG. 2, the directional coupling conductor 21 lies outside the outer conductor 12 and, therefore, no physical contact can occur between these two components. Thus, a signal output from the central conductor 11 is inductively coupled to the directional coupling conductor 21 without apprehension that physical contact might interfere the desired signal coupling.

FIG. 3 is a sectional view illustrating the shielding shutter 13 in the first embodiment as the shielding shutter 13 is slightly rotated from its position in FIG. 2 to reduce the inductive coupling between conductors 11 and 21. FIG. 4 is a view similar to FIG. 3 illustrating the outer conductor 12 in the first embodiment as the longitudinal opening 15 of the outer conductor 12 is completely closed by the shielding shutter 13. In this state, the signal output from the central conductor 11 cannot be coupled to the directional coupling conductor 21.

The outer conductor 12 may be continuously adjustably opened or closed in the manner as has been described above to adjust the signal coupling from the central conductor 11 to the directional coupling conductor 21. The feature that the shielding cover 22 can be detachably attached to the shielding shutter 13 enables the polarity or phase at which the signal coupling occurs to be selected by selecting the position at which the shielding cover 22 is attached to the shielding shutter 13.

Figure 5:
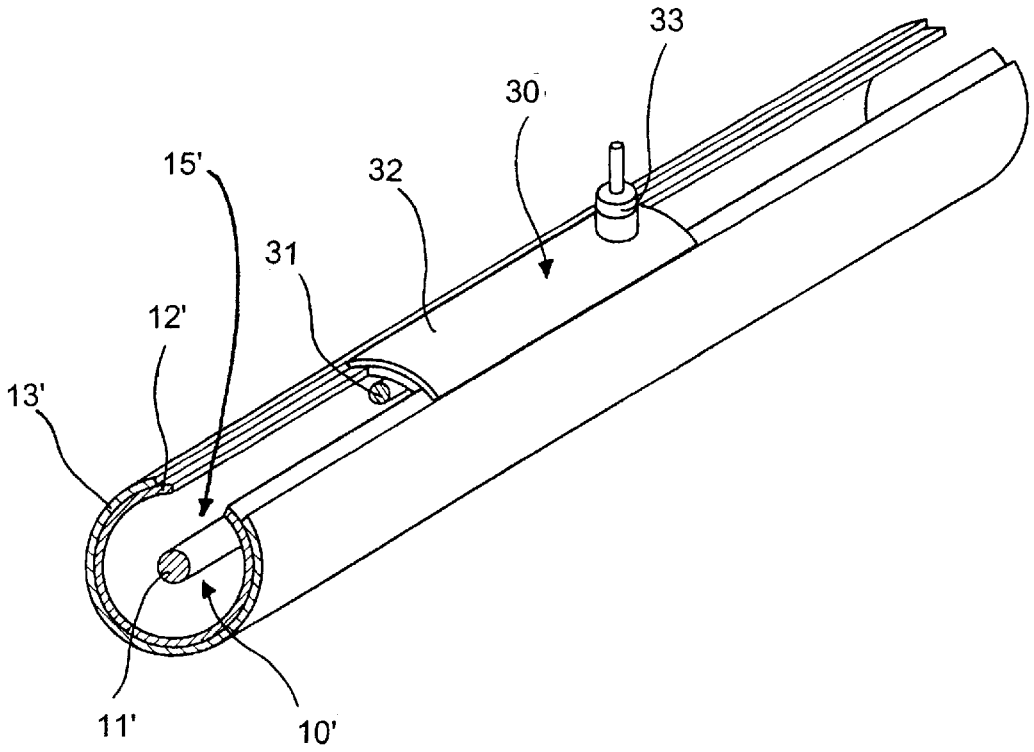
FIG. 5 is a fragmentary perspective view showing a second embodiment of the high frequency signal line according to the invention.
Figure 6:
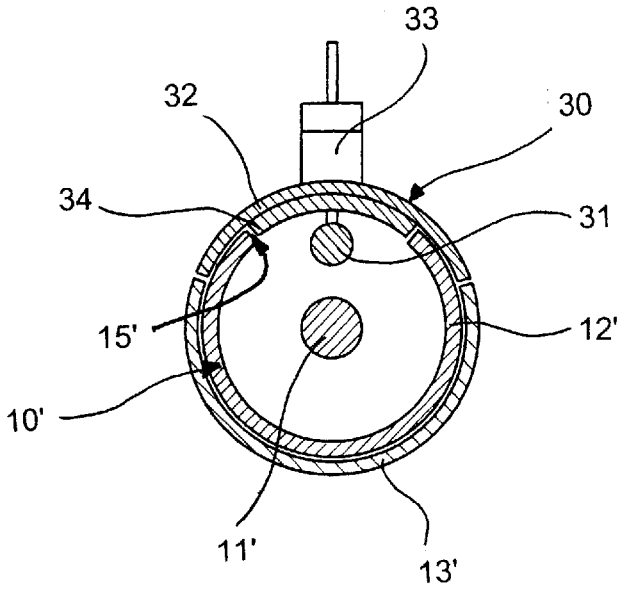
FIG. 6 is a sectional end view showing the second embodiment.

FIG. 5 is a perspective view showing a second embodiment of the invention and FIG. 6 is a sectional view illustrating a configuration of this second embodiment. The second embodiment of the inventive high frequency signal line is similar to the first embodiment in that the transmission line 10' has a central conductor 11' and an outer conductor 12' having a longitudinal opening 15', and in that the transmission line 10' is covered with a shielding shutter 13' that is positioned closely in contact with the transmission line 10'.

The induction line 30 of the second embodiment, on the other hand, has a shielding cover 32 that includes, in turn, a joint web 34 integrally provided on its inner side and having a width substantially corresponding to the width of the longitudinal opening 15' of the outer conductor 12'. Within the shielding cover 32, there is provided a directional coupling conductor 31 extending parallel to the central conductor 11' for coupling the signal output from the central conductor 11'. The directional coupling conductor 31 is connected to a branch circuit (not shown) by a connector 33 mounted on an end of the directional coupling conductor 31.

With the arrangement of the second embodiment, the signal output from the central conductor 11' can be coupled to the directional coupling conductor 31 such that the directional coupling conductor 31 cannot come in physical contact with the outer conductor 12'. In particular, the shielding shutter 13' may be covered with the shielding cover 32 to prevent the outer conductor 12' as well as said shielding shutter 13', from being further rotated. Similar to the first embodiment, the shielding cover 32 can be detachably attached to the shielding shutter 13' and, therefore, the polarity or phase at which the signal coupling occurs can be selected by selecting the position at which the shielding cover 32 is attached to the shielding shutter 13'. Further, although the induction line 30 is placed or laid over the transmission line 10' without interlocking to the shielding shutter 13', the induction line 30 may be secured to the transmission line 10' with a ring (not shown) made of, for example, rubber that is placed over the joined combination.

In either of the first two embodiments, the induction line 20 or 30 is kept separate from the transmission line 10 and thereby the longitudinal opening 15, 15' of outer conductor 12, 12' of the transmission line 10, 10' is provided to enable the signal coupling. In the first embodiment, the shielding shutter 13 is rotated to adjust a width of the opening 16 and thereby to adjust the signal coupling or leakage field strength. A horizontally polarized electromagnetic wave plane is generated thereby which has a wide frequency range.

Figure 7:
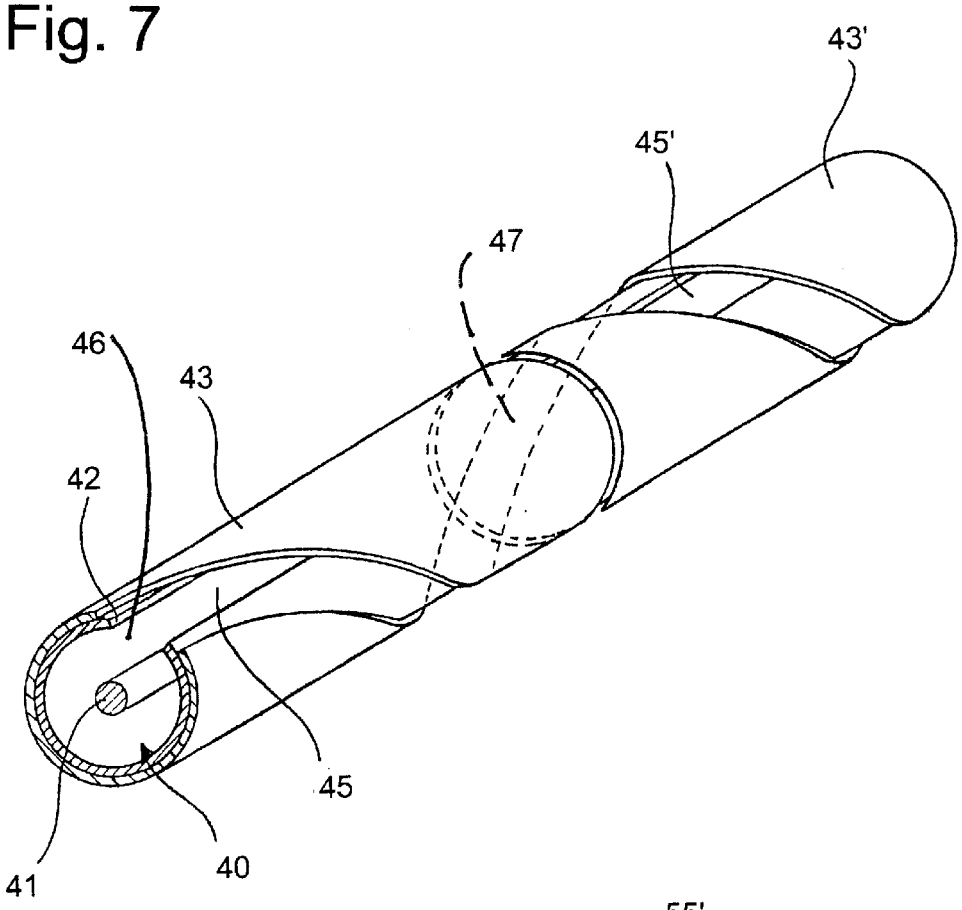
FIG. 7 is a fragmentary perspective view showing a third embodiment of the high frequency signal line according to the invention.

FIG. 7 is a perspective view showing a third embodiment of the invention. The high frequency signal line according to the third embodiment includes a transmission line 40 having a central conductor 41 and a cylindrical outer conductor 42 provided with a longitudinal opening 46. The transmission line 40 is covered with a cylindrical shielding shutter 43 that closely contacts the transmission line 40. The shielding shutter 43 is partially formed with a longitudinally extending helical or spiral opening 47. A plurality of such shielding shutters 43, 43' are arranged adjacent one another.

The longitudinal opening of the outer conductor 42 and the spiral openings 47 of the respective shielding shutters 43, 43' define together a plurality of leakage openings 45, 45' and signal leakage occurs between each pair of adjacent leakage openings 45, 45'. The shielding shutters 43, 43' are individually rotatable and one of them may be rotated relative to the adjacent shielding shutter to change a pitch between each pair of adjacent leakage openings 45, 45' and thereby to change a wave length of the inductively coupled or leakage signal. In this third embodiment, the polarized wave is vertically polarized.

Figure 8:
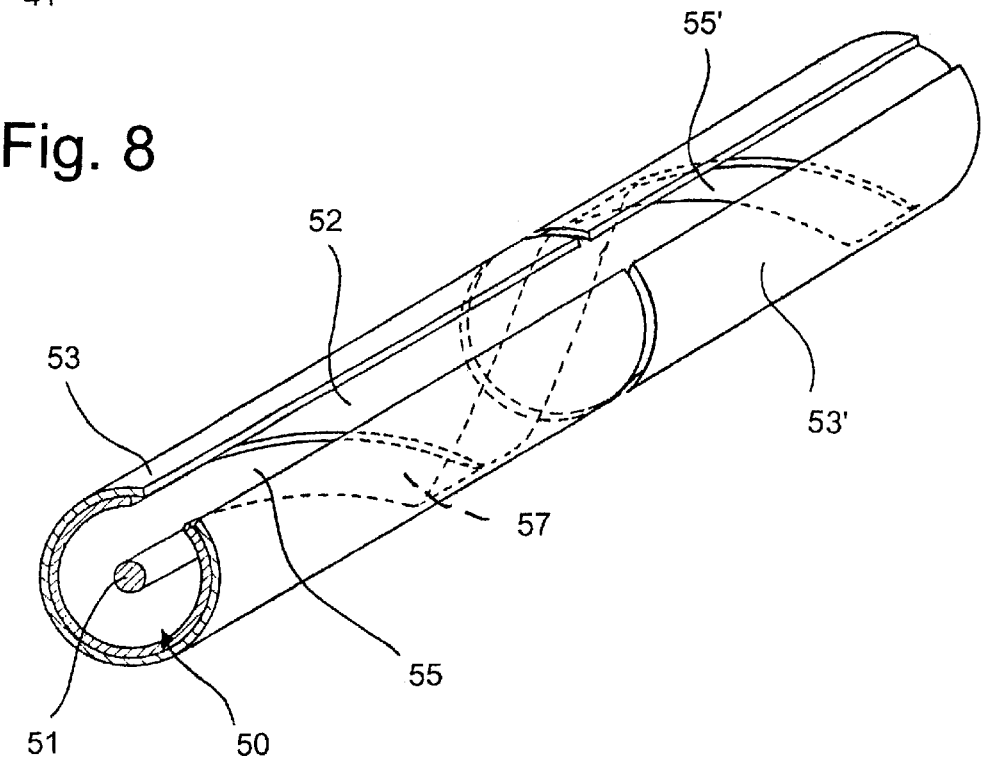
FIG. 8 is a fragmentary perspective view similar to FIG. 7 showing a fourth embodiment of the high frequency signal line according to the invention.

FIG. 8 is a perspective view showing a fourth embodiment of the invention. The fourth embodiment of the high frequency signal line includes a transmission line 50 having a central conductor 51 and a cylindrical outer conductor 52 having a longitudinally extending spiral opening 57. The transmission line 50 is covered with a cylindrical shielding shutter 53 adapted to closely contact the transmission line 50. The shielding shutter 53 is partially formed with a longitudinally extending opening. A plurality of such shielding shutters 53, 53' are arranged adjacent one another.

The spiral opening 57 of the outer conductor 52 and the longitudinal openings of the respective shielding shutters 53, 53' define together a plurality of leakage openings 55, 55' and signal leakage occurs between each pair of adjacent leakage openings 55, 55'. The shielding shutters 53, 53' are individually rotatable and one of them may be rotated relative to the adjacent shielding shutter to change a pitch between each pair of adjacent leakage openings 55, 55' and thereby change the wave length of the leak signal. Like the embodiment shown in FIG. 7, the polarized wave is vertically polarized.

Figure 9:
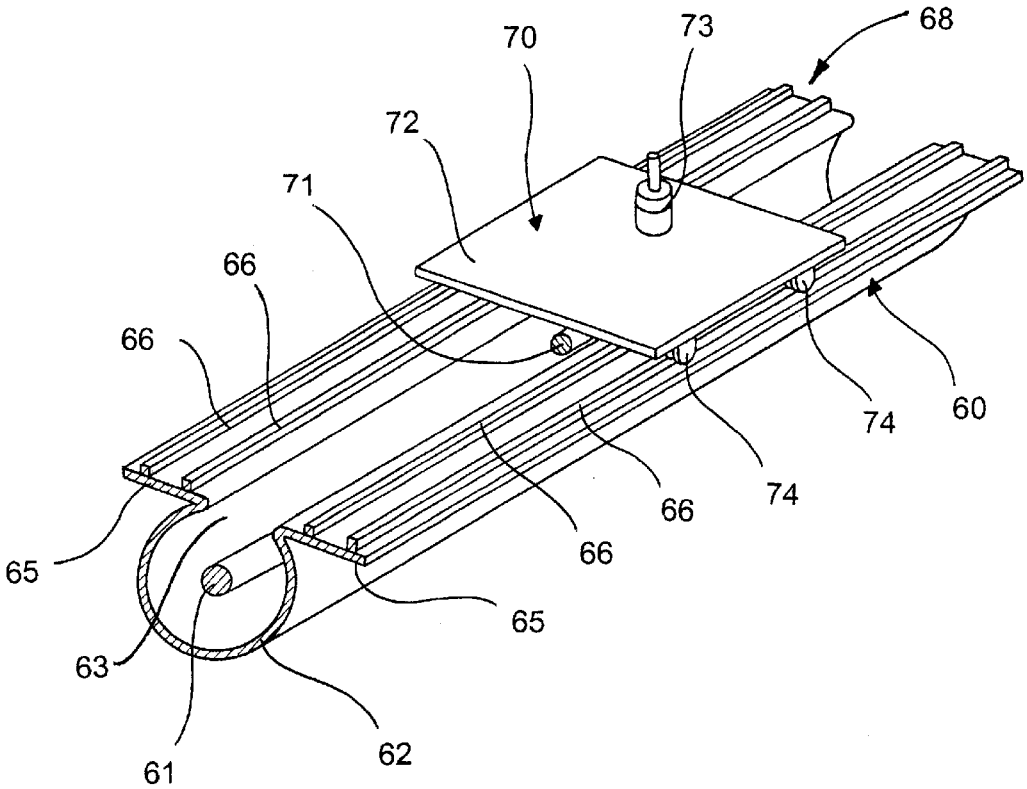
FIG. 9 is a fragmentary perspective view showing a fifth embodiment of the high frequency signal line according to the invention.
Figure 10:
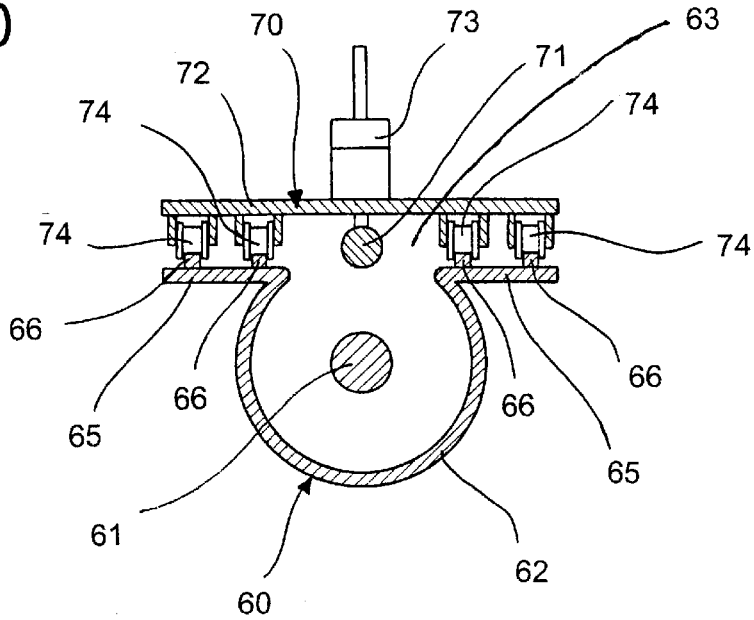
FIG. 10 is a sectional end view showing the fifth embodiment.

FIG. 9 is a perspective view showing a fifth embodiment of the invention and FIG. 10 is a sectional view showing this fifth embodiment. The fifth embodiment of the high frequency signal line has a transmission line 60 including a central conductor 61 and a cylindrical outer conductor 62 having a longitudinally extending opening 63. The outer conductor 62 is integrally provided with a pair of plate-like rail supporting wings 65 extending outwardly from the opposite edges defined by the longitudinal opening 63 of the outer conductor 62. In turn, the supporting wings 65 include a plurality of spaced rails 66 attached thereto.

An induction line 70 comprises a plate-like shielding cover 72 provided with wheels 74 to allow the shielding cover 72 to move along the rails 66. The shielding cover 72 is additionally provided with a directional coupling conductor 71 extending below the shielding cover 72 parallel to the central conductor 61 so that the signal output from the central conductor 61 may be high frequency coupled to the directional coupling conductor 71. This directional coupling conductor 71 can be connected to a branch circuit (not shown) by a connector 73 mounted on an end of the directional coupling conductor 71.

With the arrangement as has been described just above, movement of the shielding cover 72 can be easily achieved by rolling the wheels 74 of the shielding cover 72 on the rails 65. Accordingly, a transmitter (not shown) may be connected to the connector 73 to achieve continuous data transmission as the shielding cover 72 is being moved.

The fifth embodiment is similar to the first embodiment in that the shielding cover 72 can be detachably attached to the outer conductor 62 and, therefore, the polarity or phase of signal coupling can be selected by selecting the position at which the shielding cover 72 is attached to the outer conductor 62.

While the embodiment shown in FIGS. 9 and 10 has been described as having rail supporting wings 65 that are provided integrally with the outer conductor 62, an alternative arrangement includes providing a cylindrical shielding shutter having a longitudinal opening and a pair of plate-like rail supporting wings on opposite sides of the longitudinal opening integral with the shielding shutter. It is also possible to provide, not integral with the outer conductor and the shielding shutter, a pair of rail supporting wings along opposite sides defining the opening of the outer conductor 62.

While the fifth embodiment has been illustrated and described as the induction line 70 is moved along the upper side 68 of the transmission line 60, it is also possible to provide the induction line 70 for movement along the lower side of the transmission line 60.

While the outer conductor 12, 42 or 52 and the shielding shutter 13, 43 or 53 have been described hereinabove as having the form of cylindrical tubes, the outer conductor 12, 42 or 52 as well as the shielding shutter 13, 43 or 53 may be provided in the form of polygonal tubes as long as the shielding shutter 13, 43 or 53 is rotatable.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A high frequency signal line comprising:

a transmission line having a central conductor and an outer conductor at least partially surrounding said center conductor, said outer conductor formed with a first longitudinally extending opening;

a conductive shielding shutter at least partially surrounding said center conductor, said shutter conforming to the shape of said outer conductor and formed with a second longitudinally extending opening, said shielding shutter coupled to said transmission line; and an induction line for coupling energy from said transmission line, said induction line having a shielding cover formed with a third longitudinally extending opening and having a directional coupling conductor that extends within said shielding cover generally parallel to said central conductor, said shielding cover detachably attached to said shielding shutter.

2. A high frequency signal line as defined in claim 1, wherein said induction line and said shielding shutter are rotatable relative to said transmission line to adjust the inductive coupling between said induction line and said transmission line.

3. A high frequency signal line as defined in claim 2, wherein said induction line includes a connector that is attached to an end of said directional coupling conductor for connecting said induction line to a branch circuit.

4. A high frequency signal line as defined in claim 1, wherein said second longitudinally extending opening of said shielding shutter is defined by a pair of raised opposite edges, said edges including a plurality of one of spaced holes and spaced pins, and said third longitudinally extending opening is defined by a pair of outwardly-projecting opposite edges that include a plurality of the other of spaced holes and spaced pins, said holes adapted to receive said pins to lock said shielding cover to said shielding shutter at a selected position.

5. A high frequency signal line as defined in claim 4, wherein a polarity and phase of signal coupling can be selected by selecting the position at which said shielding cover is attached to said shielding shutter.

6. A high frequency signal line as defined in claim 1, wherein said outer conductor and said shielding shutter are cylindrical.

7. A high frequency signal line as defined in claim 1, wherein said shielding cover is trough-shaped and said directional coupling conductor extends lengthwise within said shielding cover such that said directional coupling conductor is positioned outside said shielding shutter.

8. A high frequency signal line comprising:

a transmission line having a central conductor and an outer conductor at least partially surrounding said central conductor, said outer conductor formed with a first longitudinally extending opening;

a conductive shielding shutter at least partially surrounding said center conductor, said shutter conforming to the shape of said outer conductor and formed with a second longitudinally extending opening, said shielding shutter coupled to said transmission line; and an induction line for coupling energy from said transmission line, said induction line including a shielding cover detachably fastened to said outer conductor, said induction line also including a directional coupling conductor for high frequency coupling which extends within said shielding cover parallel to said central conductor.

9. A high frequency signal line as defined in claim 8, wherein said outer conductor and said shielding shutter are cylindrical.

10. A high frequency signal line as defined in claim 8, wherein said induction line and said shielding shutter are rotatable relative to said transmission line to adjust the inductive coupling between said induction line and said transmission line.

11. A high frequency signal line as defined in claim 10, wherein said induction line includes a connector that is attached to an end of said directional coupling conductor for connecting said induction line to a branch circuit.

12. A high frequency signal line as defined in claim 8, wherein a polarity and phase of signal coupling can be selected by selecting the position at which said shielding cover is attached to said outer conductor.

13. A high frequency signal line as defined in claim 8, wherein said shielding cover is trough-shaped and said directional coupling conductor extends lengthwise within said shielding cover such that said directional coupling conductor is positioned outside said shielding shutter.

14. A high frequency signal line as defined in claim 8, wherein said shielding cover has an inner side having a joint web provided thereon, said web having a width substantially corresponding to the width of said first longitudinally extending opening for resisting rotational movement of said shielding shutter and said outer conductor when said induction line is attached to said transmission line.

15. A high frequency signal line comprising:

a transmission line having a central conductor and a cylindrical outer conductor at least partially surrounding said central conductor, said transmission line formed with a first longitudinally extending opening;

a cylindrical conductive shielding shutter at least partially surrounding said center conductor, said shutter conforming to the shape of said outer conductor and formed with a second longitudinally extending opening, said shielding shutter coupled to said transmission line such that said shutter is rotatable relative to said transmission line for adjustably widening or restricting said first opening of said transmission line; and an induction conductor coupled to said transmission line to be exposed to said first opening of said transmission line for selectively coupling energy from said transmission line.

16. A high frequency signal line comprising:

a transmission line having a central conductor and a cylindrical outer conductor at least partially surrounding said central conductor, said transmission line formed with a first longitudinally extending opening;

a cylindrical conductive shielding shutter at least partially surrounding said center conductor, said shutter conforming to the shape of said outer conductor and formed with a second longitudinally extending opening, said shielding shutter coupled to said transmission line such that said shutter is rotatable relative to said transmission line for adjustably widening or restricting said first opening of said transmission line; and wherein said second opening is a spiral opening along the length of said shutter.

17. A high frequency signal line comprising:

a transmission line consisting of a central conductor and a cylindrical outer conductor surrounding said central conductor and formed with a helical opening; and at least one conductive shielding shutter at least partially surrounding said center conductor, said shutter conforming to the shape of said outer conductor and partially formed with a longitudinally extending opening, said shutter coupled to said transmission line.

18. A high frequency signal line comprising:

a transmission line having a central conductor and a cylindrical outer conductor at least partially surrounding said center conductor and formed with a longitudinally extending opening, said opening defining opposite edges, each said edge having a rail supporting wing extending outwardly therefrom, each said wing having a plurality of rails thereon that are parallel to said outer conductor; and an induction line including a conductive shielding cover for extending over said opening, said cover having a plurality of wheels adapted to move along said rails for adjusting the position of said shielding cover along said transmission line, and including a directional coupling conductor for high frequency coupling, said coupling conductor extending within said shielding cover parallel to said central conductor.

19. A high frequency signal line as defined in claim 18, wherein said transmission line is covered with a cylindrical shielding shutter formed with a longitudinally extending opening.

* * * * *